US005984840A

United States Patent [19]

Awbrey et al.

[11] Patent Number: 5,984,840

[45] Date of Patent: Nov. 16, 1999

[54] WATER THERAPY FITNESS CUFFS AND MITTS

[76] Inventors: Brian J. Awbrey; Kipp K. Dye, both of 9 Raymond Rd., Newton, Mass. 02165

[21] Appl. No.: 08/813,006

[22] Filed: Mar. 4, 1997

Related U.S. Application Data

[60] Provisional application No. 60/022,984, Aug. 2, 1996.

[51] Int. Cl.[6] ..... A63B 69/12

[52] U.S. Cl. ..... 482/55; 482/111; 434/254

[58] Field of Search ..... 482/55, 56, 111, 482/112, 44; 128/881; 602/63; 434/254

[56] References Cited

U.S. PATENT DOCUMENTS

| | | | |
|---|---|---|---|
| 2,059,136 | 10/1936 | Moller | 128/881 |
| 2,663,295 | 12/1953 | Lenwedowski et al. | 128/881 |
| 4,247,097 | 1/1981 | Schwartz | 482/44 |
| 4,544,155 | 10/1985 | Wallenbrock et al. | 482/55 |
| 4,551,108 | 11/1985 | Bass | 482/111 |
| 4,804,326 | 2/1989 | Lennon | 482/55 |
| 4,923,418 | 5/1990 | Hoffman | 482/55 |
| 5,490,823 | 2/1996 | Awbrey et al. | 482/111 |
| 5,643,155 | 7/1997 | Kallassy | 482/111 |

*Primary Examiner*—Stephen R. Crow
*Attorney, Agent, or Firm*—Jerry Cohen; Edwin H. Paul

[57] ABSTRACT

An exercising device which includes a cuff and a mitt usable separately or together. The cuff being a body of flexible material arranged with a central opening therethrough, and including an inner surface of an elastic material to be placed against the skin of a user, an outer surface of an elastic material, the inner and outer surfaces being joined but spaced apart to form a space. There is a flexible ballast material disposed in the space between the inner and outer surfaces and an elastic material. There is a separation disposed along the body, including a strong VELCRO strap, and a flexible attachment, and there is webbing of an elastic material disposed at the inner surface and outer surface as well as an O-ring attached to the outer surface.

3 Claims, 3 Drawing Sheets

WATER THERAPY FITNESS CUFFS AND MITTS

CROSS REFERENCE TO RELATED APPLICATIONS

This application claims, under 35 USC §119 and §120, the benefit of a provisional application, filed Aug. 2, 1996, under 35 USC §111(b), entitled Water and Land Therapy Fitness Cuffs and Mitts, and assigned Ser. No.: 60/022,984.

FIELD OF THE INVENTION

The present invention relates generally to exercise and rehabilitation equipment, and, more specifically, to rehabilitation and fitness devices designed for use particularly in the water, e.g., a swimming pool.

BACKGROUND OF THE INVENTION

The generally continual rise in fitness awareness has led many millions of Americans to appreciate the benefits of exercise. Presently, there is a strong emphasis on muscular toning and cardiovascular conditioning along with injury prevention.

Rehabilitation has also been experiencing explosive growth quite parallel to the fitness, probably due to the awareness of the importance of health maintenance and injury prevention brought about by the fitness industry.

Rehabilitation, along with fitness, focuses on muscular toning and cardiovascular enhancement, but, in many musculoskeletal and neuromuscular dysfunctions, resulting from traumatic or overuse injury and disease, neuromuscular proprioceptive facilitation of awareness, control, and quality or level of finctional capacity and training is important to aid in the restorative process to impaired joints within the extremities, torso, head and neck.

Approximately ten years ago aquatic exercise for rehabilitation and fitness emerged until it is now the fastest growing sector within the fitness market, and is the latest development in rehabilitation. There has also been an explosive proliferation of aquatic exercise devices during the past decade.

There are numerous patents which pertain to an aquatic glove for swimming and/or aquatic exercise. U.S. Pat. No. 5,312,278 issued May 17, 1994, discloses a swimming glove which extends over the front-half portion of the forearm of the wearer.

An exercise glove is disclosed in U.S. Pat. No. 5,004,227 which allows for retaining a weight on a user's hand and comprises a support having a backhand portion with an insert pocket disposed on the backhand portion, for receiving the weight. A strap arrangement is mounted across the insert pocket for removably securing the weight within the insert pocket.

U.S. Pat. No. 4,923,418 allows for retaining a weight on a user's palmar surface.

There is also another, of many web glove designs with variations in functional intent, U.S. Pat. No. 4,892,496. This is a glove with an elongated finger portion intended to accommodate the little finger of a swimmer and the swimmer's distal elongated thumb portion. The purpose of this glove design is to allow one to maintain an outstretched hand while swimming.

BRIEF SUMMARY OF THE INVENTION

One of the objects of the present invention is to provide aquatic exercising and rehabilitation devices having the ability to provide for enhancement of resistance over and above the natural resistance the water provides during aquatic exercise.

Another object of the present invention is to provide aquatic exercising and rehabilitation devices which allow the user to choose from many different exercises for the upper and lower extremities.

These and other objects are accomplished by use of cuffs and/or mitts together with an elastic-resistive tether cord for providing resistance to movement in addition to that of the water. The preferred embodiment is constructed of a soft, flexible, buoyant, and resilient material.

The present invention provides added resistance and buoyancy for the user in the water.

Other objects, features and advantages will be apparent from the following detailed description of preferred embodiments taken in conjunction with the accompanying drawings in which:

DETAILED DESCRIPTION OF THE PREFERRED EMBODIMENTS

Figure 1:
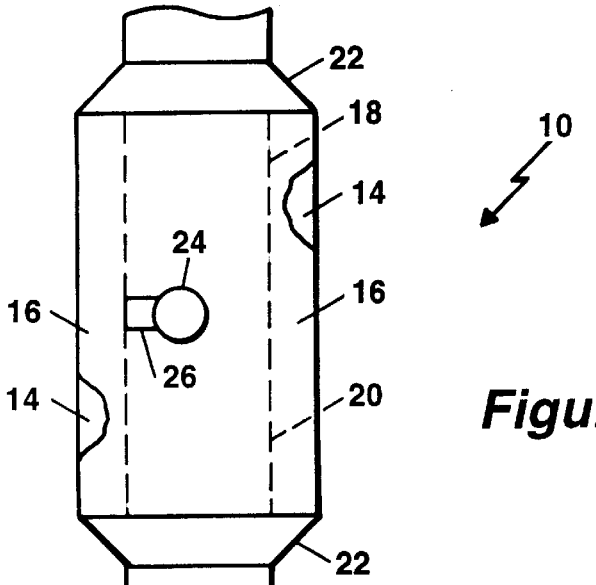
FIG. 1 is an elevational side view of the cuff.

FIG. 1 shows the cuff generally at 10, which is constructed of flotation material or cells 14, such as closed cell foam, which is surrounded by an elastic, durable material 16, such as neoprene, which can be buoyant. The edges 18 of the flotation cells 14 have stitching 20 to hold the flotation cells in place within the elastic material covering 16. The edges are those of the material which surrounds the flotation cells. Each cell 14 has material 16 surrounding it, after which these are sewn to each other. At each end of the cuff 10 is a strong ridged ring 22 made of extremely durable, yet flexible, and somewhat pliable material. This material may be a high impact plastic. Ring 22, located at each end of the cuff 10 provides added integrity to the overall structure of the device. An O-ring 24 is attached to the cuff 10 using a strong flexible strap 26. These O-rings act as attachment sites for the elastic cords. The flexible strap can be made of latex tubing, for example. The flexible strap 26 allows the O-ring 24 to change its position when the elastic-resistive cord 28 (not shown in this Figure) places tension upon it.

Figure 2:
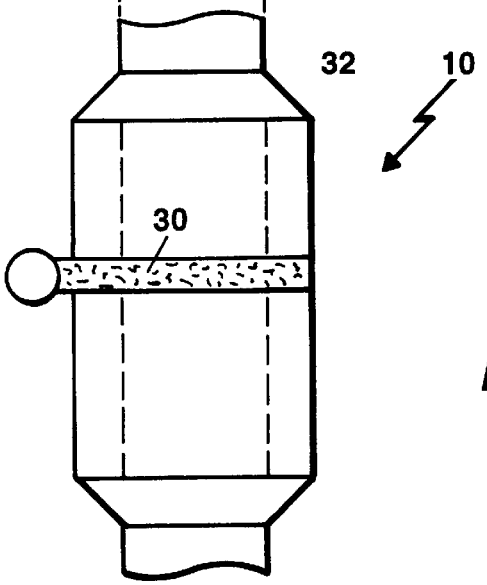
FIG. 2 is an elevational side view of another embodiment of the cuff.

FIG. 2 shows a modified embodiment from that shown in FIG. 1, but has two additional components. There is a strong VELCRO strap 30 (or zipper) used when the cuff is designed with a separation 32, rather than being continuous as in FIG. 1, to allow easy donning and doffing. This is used if a person has a sprained ankle and would not be able to stretch the cuff 10 over the user's ankle, for example, without possibly damaging the injured joint further. A user inserts and removes the limbs through the central opening which runs the entire length of the device.

Figure 3:
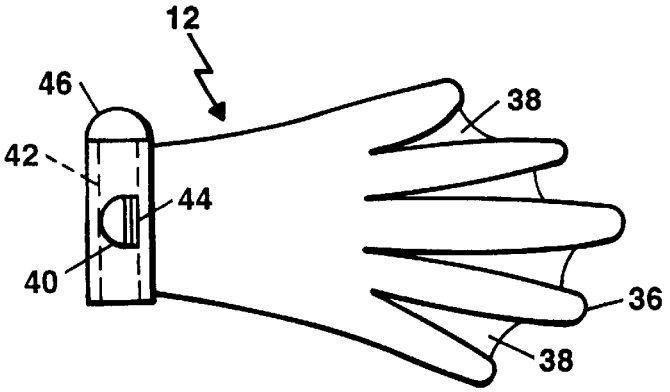
FIG. 3 is an elevational dorsal view of the mitt.
Figure 4:
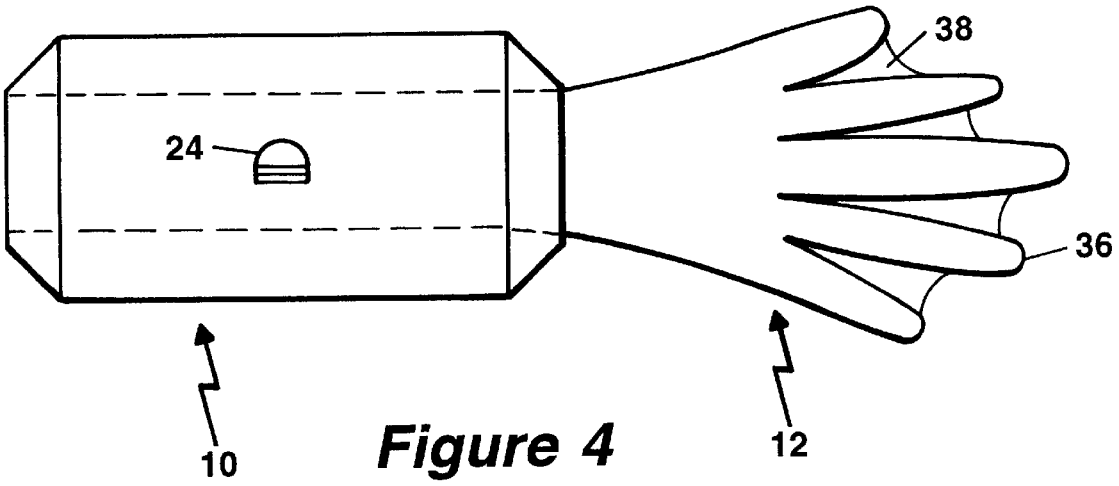
FIG. 4 is an elevational dorsal view of the combined cuff and mitt.

FIG. 3 shows the mitt generally at 12 made of flexible, durable, non-buoyant or buoyant material 34. This material may be closed cell foam covered by neoprene which will allow the mitts to be buoyant. In the preferred embodiment, the mitt 12 is shaped similarly to a person's hand, with stitching 36 that follows the outline of the hand and fingers. There is a web space 38 formed between the fingers and thumb which allow for entrapment of water during movement through the water medium for increased resistance during exercise. There is also located on the mitt 12 an O-ring 40 which is attached to the adjustable wrist band 42 via a durable and flexible strap 44. For enhanced fit of the wrist band 42 there is a buckle 46 which allows for passage of the wrist band 42 which is made of a strong flexible material with VELCRO for closure.

Figure 7:
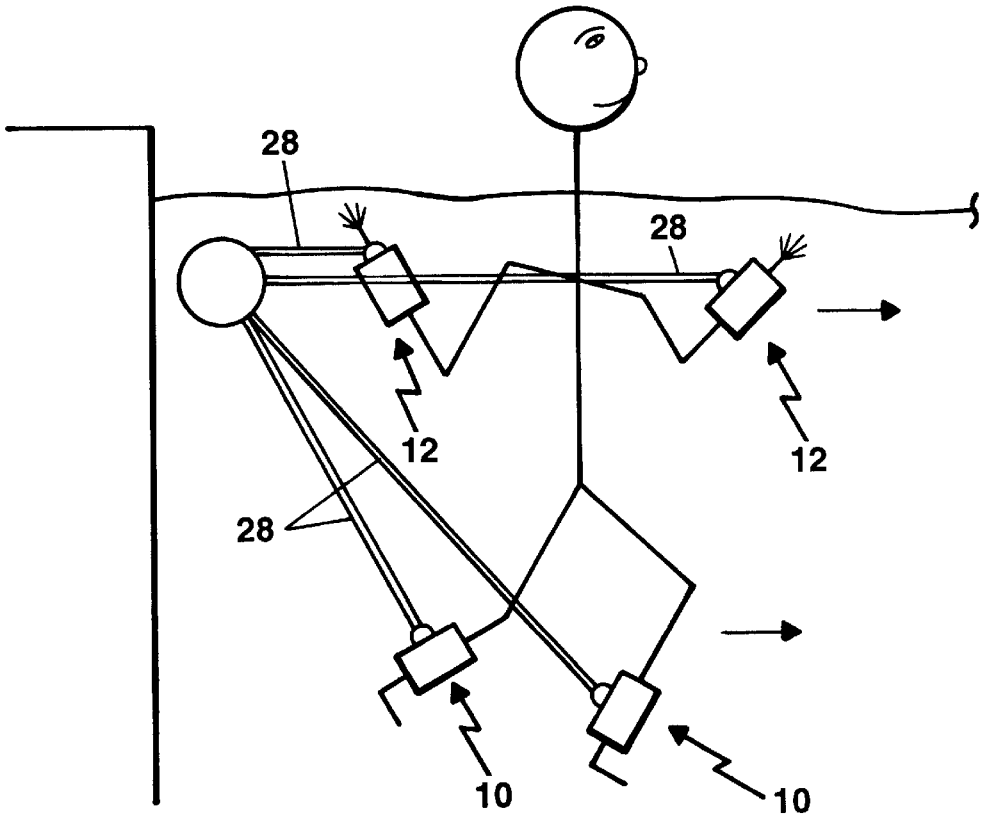
FIG. 7 is a diagrammatic view of the cuffs, mitts and elastic-resistive cords being used in deep water.

An example of an upper extremity exercise is one where the exerciser orients, for example, the soft buoyant surface of the preferred embodiment facing, at any angle, to the frontal plane of progression (see FIG. 7 for clarification) through the water medium. The cuff 10 is worn over the wrist or forearm. Resistance increases the more one orients the surface of the preferred embodiment toward 90 degrees to the direction of movement within the water medium, with theoretically maximal resistance attained at 90 degrees.

The user can select how much resistance the cuffs 10 and mitts 12 can produce based upon:

1. The speed at which the cuffs 10 or mitts 12 are moved through the water;
2. At what percentage of total submersion the preferred embodiments are held;
3. What particular angle to the direction of movement the cuffs 10 and mitts 12 are positioned; and
4. The density of the material or materials of the preferred embodiments determines the buoyancy or relative density, and thus if the buoyancy is to be changed, one way to accomplish this is to change the materials used. This is determined in advance by comparing the density of the object to that of the water in which the device is to be used.

Figure 5:
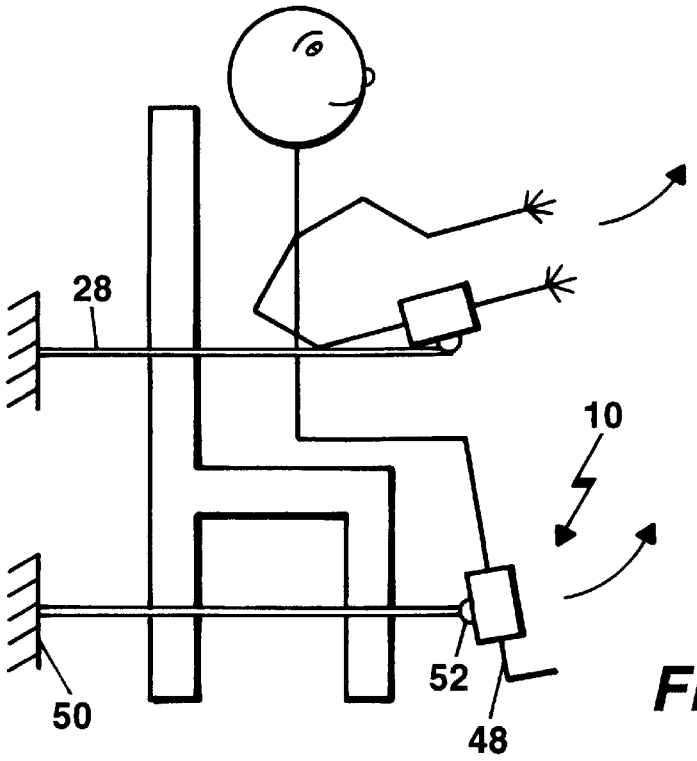
FIG. 5 is a diagrammatic side view showing the cuffs used on both arms and legs of a user simultaneously to provide a total body workout.
Figure 6:
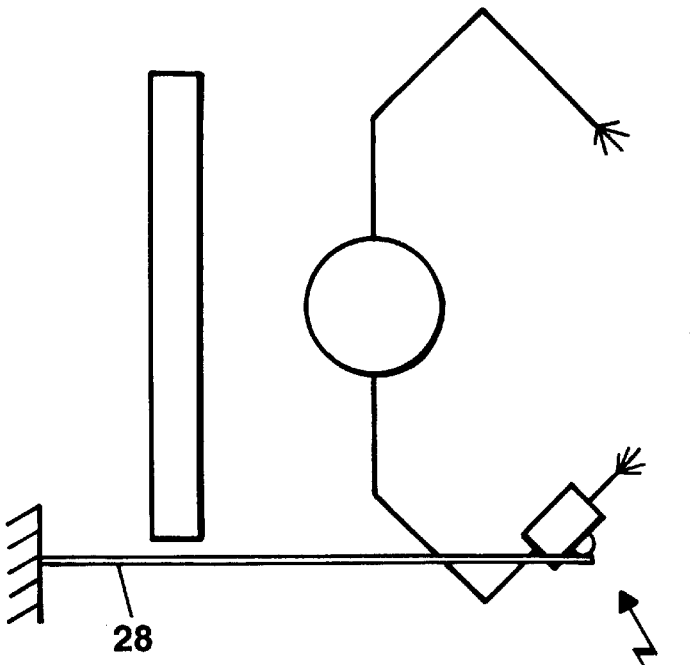
FIG. 6 is a diagrammatic top view showing a cuff in use with the elastic-resistive cord during a shoulder exercise.

The cuffs 10 can additionally be used for many lower extremity exercises. An example is using the cuffs 10 over the ankles 48 for water running or when the user performs seated bilateral or alternating knee flexion and extension as shown in FIG. 5. This exercise enhances strength, coordination, flexibility, and balance which may be utilized in fitness training and rehabilitation.

The cuffs 10 and mitts 12 can be used as flotation aids for therapists, trainers, and aquatic specialists. An example of this particular usage is when a patient/client lies supine or prone, or in an upright position, depending upon the particular requirements of an exercise or series of exercises. For example, if a patient has a neck or back strain the supine or upright positions will probably be desired. Injuries other than those which involve the spine can usually tolerate prone, supine, and upright positions. In this case, one may use a pair or two pairs of cuffs which can be placed for usage on two or all four extremities (keeping in mind that the mitts are only used on the hands and wrists).

The invention provides balance, or proprioceptive training. The human body contains multiple proprioceptive sensory organs (MPSO) which inform the central nervous system of the position or orientation in space where each joint is located relative to one another, and provides various other qualitative and quantitative elements specific to each joint such as: velocity; degree of rotation; compression; torque; elasticity of the tissue in close proximity to the joint; and the perceived integrity or stability of each joint. These MPSO are truly the limiting factor to one's stability during any static or dynamic task or series of tasks/movements. Without correct functional operation of the MPSO one literally loses the ability to perform any movement with safety, control, or grace/fluidity. The present invention, when used as a balance training device, brings into usage three innate neurological human neurophysiological responses:

1. righting reactions;
2. balance reactions; and
3. a protective extension response.

Righting reactions involve orienting movement of the head, neck, and body to maintain the eyes horizontal, head vertical, and the body in proper relationship to the head. Stimulus may be optical, labyrinthine, or tactile of which the water is a perfect dynamic medium for these stimuli to occur due to its innate physical characteristics.

Secondly, balance reactions are movements that attempt to maintain the center of gravity or buoyancy (COG or COB) within the base of support (BOS), which is defined as the outermost limits or edges of the person's balance range. Equilibrium reactions are mediated through the more peripheral proprioceptive receptors.

Thirdly, the protective extension response involves a movement by an extremity or combination of movements that changes the BOS to accommodate the position of the COG or COB to bring the COG or COB within the new BOS. An example of this would be when someone reaches out their arm to stop or break them from falling, either in the sitting or standing position.

Both the mitts 12 and cuffs 10 are designed to allow for the attachment to an elastic-resistive cord 28 to allow for dynamic elastic-resistive exercising in the water. This unique feature allows for the selection of varying amounts of resistance dependent on the tension generated during exercise. Optimal strengthening and stretching in one's therapeutic or fitness program can be achieved with the usage of elastic-resistive cords.

The cord 28 is anchored to an attachment point 50, such as an eyelet for a lane line or even wrapped around a rail on a ladder. Then the hook ends 52 of the tether cord are hooked into the O-rings on the cuffs and/or mitts allowing for the tension to be generated along the long axis of the elastic tether cords. Simply stated, when there is more distance between the attachment point and the O-rings on the cuffs and/or the mitts there is more tension generated which directly translates into increased resistance during a movement/exercise.

The preferred embodiments can also be used on land for rehabilitative and fitness purposes. The mitts and cuffs must be used in combination with the elastic-resistive tether cords to allow for resistive exercise training on land since the air does not provide enough resistance at the slow speeds attained during usual rehabilitative and fitness programs.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

We claim:

1. An exercising device, comprising:

a.) a body of flexible material arranged with a central opening therethrough, the central opening having a first end and a second end, wherein the central opening defines an axis, and including i.) an inner surface of an elastic material to be placed against the skin of a user, ii.) an outer surface of an elastic material, said inner and outer surfaces being joined but spaced apart to form a space, iii.) a flexible ballast material disposed in the space between said inner and outer surfaces; and iv.) a structural ring comprising a plastic material encircling each of the ends, wherein the structural rings provide strength to the exercising device;

b.) an O-ring attached to the outer surface; and, c.) an elastic resistive cord detachably connected to said O-ring and connectable to a nonmovable support to provide elastic resistance to movement of the body when the cord is attached to a nonmovable support such that the user wearing the body of flexible material may move to stretch the elastic resistive cord thereby providing exercise for the user.

2. An exercising device as defined in claim 1, wherein the central opening and the elastic material is constructed to fit over the wrists or ankles of an adult human on land.

3. An exercising device as defined in claim 1, wherein the elastic resistive cord comprises a hook assembly and wherein the O-ring has a flexible attachment to accommodate the hook assembly.

* * * * *